US005579597A

United States Patent [19]

Stewart

[11] Patent Number: 5,579,597

[45] Date of Patent: Dec. 3, 1996

[54] COMBINED DOOR AND DISPLAY PANEL FOR CONSUMER ELECTRONICS PRODUCTS

[75] Inventor: David S. Stewart, Palatine, Ill.

[73] Assignee: Zenith Electronics Corporation, Glenview, Ill.

[21] Appl. No.: 365,854

[22] Filed: Dec. 29, 1994

[51] Int. Cl.[6] ..... G09F 3/04

[52] U.S. Cl. ..... 40/451; 40/547; 362/31

[58] Field of Search ..... 40/546, 547, 451, 40/580; 362/26, 27, 30, 31, 32

[56] References Cited

U.S. PATENT DOCUMENTS 4,106,231 8/1978 MacNiel ..... 40/547
4,163,883 8/1979 Boulanger ..... 40/546 X
4,322,780 3/1982 Murakami et al. ..... 362/31
4,555,694 11/1985 Yanagishima et al. ..... 40/547 X
4,791,746 12/1988 Coronato ..... 40/547
4,975,807 12/1990 Ohashi ..... 362/26 X

*Primary Examiner*—Peter M. Cuomo
*Assistant Examiner*—James O. Hansen

[57] ABSTRACT

A combination media ingress/egress door and display panel for a consumer electronics product is disclosed as having tunnels therein with openings for receiving light from controllable light sources mounted within the casing. The opposite end of the tunnels connect with the front face of the display panel. The front openings are fitted with lenses or overlays in the shape of the necessary information segments. Thus, the combination door and display panel has no electrical components or connections thereon which would be subject to undue mechanical stress which might cause failure of the display.

11 Claims, 2 Drawing Sheets

COMBINED DOOR AND DISPLAY PANEL FOR CONSUMER ELECTRONICS PRODUCTS

BACKGROUND OF THE INVENTION

1. Field of the Invention

The present invention relates generally to consumer electronics products of the type having a door for the ingress and egress of recorded or recording media, such as magnetic tapes, and further having an information display panel associated with the product.

2. Discussion of the Related Art

Consumer electronics units of the type above-mentioned may include video cassette recorders/players (VCRs), compact disc players, or audio-cassette players. A door covering the ingress/egress area for recorded media is often situated substantially flush with the front panel of the unit in its closed position to cover the ingress/egress "throat" of the unit so as to prevent dust from entering the unit and for appearance sake.

Such units will often have an information display panel for conveying information to the operator of the unit such as time, function, tape count, etc. The display generally has lighted segments for displaying variable alphanumeric information. Icons for the display of less rapidly varying information may also be included.

Owing to the desire for ever smaller overall size of these units and the desire for stylistic differentiation and design freedom for the shape of the unit, one possible accommodation for these desires is to incorporate the information display within the media ingress and egress door, thereby allowing a saving of surface area on the front panel of the unit or the possibility of unique designs where a separate door and display panel need not be accommodated on the front panel.

Possible problems with integrating the door and the display arise with certain types of units such as VCRs where a pivoting door can slam open or closed or encounter contact with the cassette, subjecting the door to shock and vibration. Thus, electronic displays such as the light emitting diode (LED) type, liquid crystal display (LCD), or fluorescent display panel (FDP) type displays incorporated into the door may fail due to such forces. Also the electrical connections to such door-mounted displays would have to be flexible and/or movable and would undergo flexing/stresses as well as the aforementioned shock and vibration.

3. Objects of the Invention

It is, therefore, among the objects of the present invention to provide a combined door and display panel for a consumer electronics product or unit, having a media ingress/egress door and an information display panel. It is, further, among these objects to provide such a combined door and display panel which is nearly immune to shock and vibration. It is another object of the present invention to provide a combined door and display panel which has no electrical connection to the moving door part.

Other attendant advantages will be more readily appreciated as the invention becomes better understood by reference to the following detailed description and compared in connection with the accompanying drawings in which like reference numerals designate like parts throughout the figures. It will be appreciated that the drawings may be exaggerated for explanatory purposes.

DETAILED DESCRIPTION OF THE PREFERRED EMBODIMENT

Figure 1:
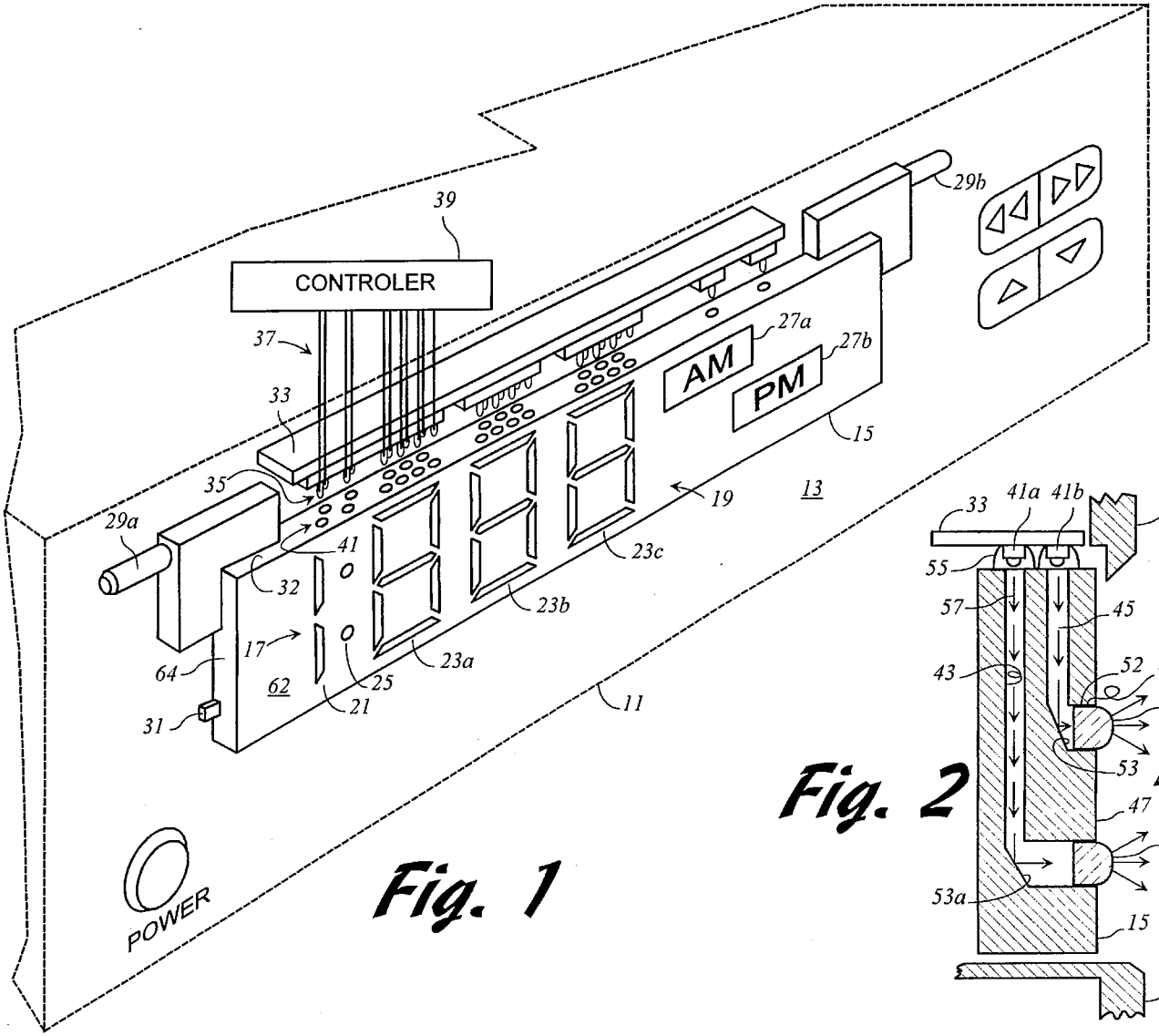
FIG. 1 is a schematic, perspective view of a VCR case, shown in phantom, incorporating the features of the present invention.

As seen in FIG. 1 a VCR 11, the casing of which is indicated in dashed lines, is shown as having a front panel 13 having a media access door 15 incorporated therein for the ingress and egress of recorded media, i.e., a video cassette (not shown). Incorporated within the door 15 is a display panel 17 having alphanumeric characters 19 which are of the two-segment variety 21 and seven-segment variety 23A, 23B, 23C as well as a colon 25 separating the two-segment character from the seven-segment characters. Also included on the display panel are AM/PM time indication icons 27A, 27B, respectively. Also included as a part of the door are pivots 29A, 29B connecting the door to the VCR case and a forward movement stop flange 31.

Contained within the case of the VCR 11 and mounted adjacent the top surface 32 of the door 15 is a printed circuit board 33. Mounted on the printed circuit board 33, as further explained below, are light emitting diodes (LEDs) 35 which are wired as necessary by electrical connections 37 to a controller 39 which lights the proper LEDs in the proper sequence to produce an illuminated character on the light emitting display panel. The door 15 has tunnel openings 41 on the top side 32 thereof proximate the LEDs 35 as further explained below. Only the first two characters are shown as wired to avoid cluttering the drawing.

Figure 2:
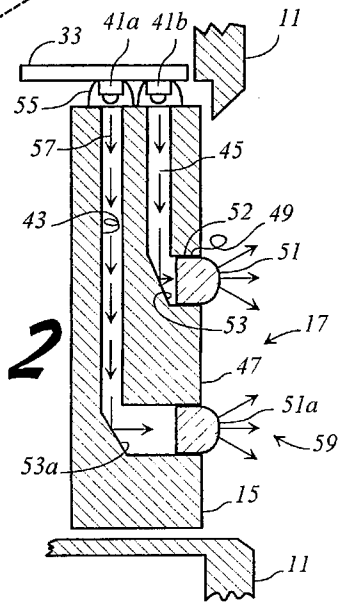
FIG. 2 is a cross-sectional view of the door/display panel area of the VCR of FIG. 1

As seen in FIG. 2, a cross-section of the combined door and display panel area reveals the inner structure of an embodiment according to the present invention. The door 15 can be molded of opaque material as a solid one-piece unit with tunnels 43, 45 formed therein. The tunnels are for the transmission of light from the LEDs 41A, 41B. Other small and directional light sources may be found suitable for use. Each tunnel, e.g., 45 extends through the door to an opening 49 on the front face 47 of the door/display panel. Inserted into the front face opening 49 is a lens 51 of the shape of an information segment of one of the segmented alphanumeric characters, such as those of 23A (FIG. 1). The lens 51 is preferably a light diffuser in order to eliminate bright spots which may result at the point of the lens directly behind the tunnel 45. The lens 51, while shown as being inserted only partially into the tunnel portion 52 perpendicular to the front face, may also be formed so as to fit completely therethrough and reach the back reflective portion 53 of the tunnel (shown here at 43) which has been coated with a reflective material in a separate operation, such as by hot stamping with aluminized foil or the like. Alternatively, if the lens is shaped to fit completely to the back reflective portion of the tunnel 53 the lens itself could be provided with an angled portion and have a reflective material placed thereon. Surrounding each LED, e.g., 41*a* is a hood 55 which extends to adjacent the top of the door 15 so as to prevent stray emission of light to anywhere but the tunnels of the display panel construction. Light, as indicated by arrow path 57, exits the LED 41*a* when the LED is activated by controller 39 (FIG. 1) and travels down the tunnel 43 to hit the back reflective surface 53*a* of the tunnel 43 whereupon it exits through the lens 51*a* and disburses as indicated by arrows 59.

As an alternative to the one-piece molded construction shown in FIG. 2, it will be appreciated that multiple plates having portions of the tunnels formed therein could be fitted together as necessary to construct a door/display panel according to the present invention. Further, a defuser overlay, or the like, could be used in place of the indicated lenses. It will also be appreciated that the icons 27A, 27B of FIG. 1 could also use suitable overlays rather than painted or etched lenses.

Figure 3:
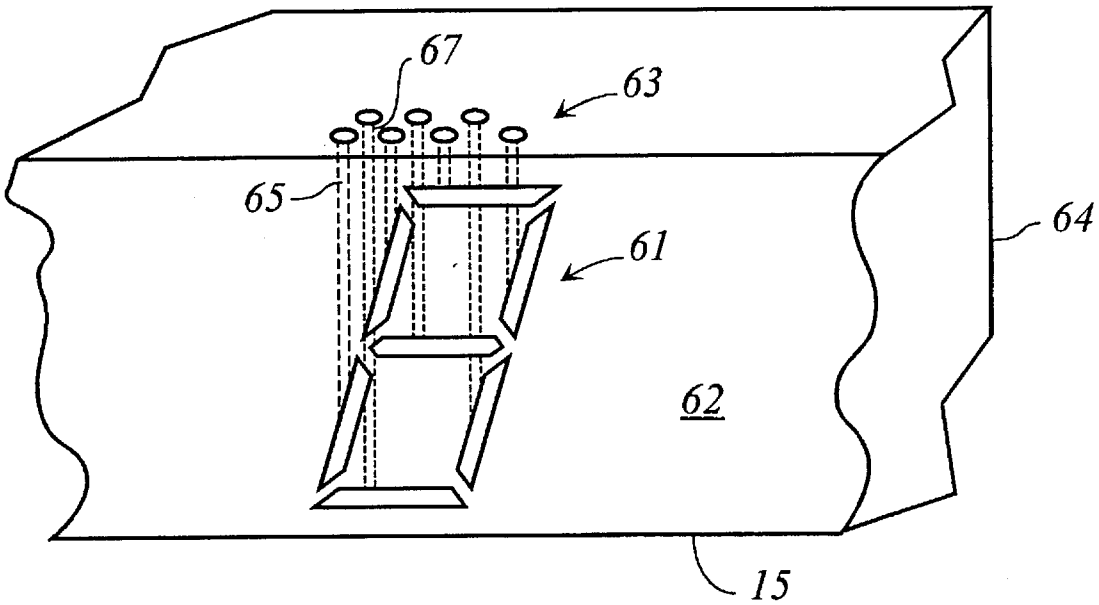
FIG. 3 illustrates a seven-segment alphanumeric display character and the light connections thereto within a door according to the present invention.

Referring to FIG. 3, there is shown a seven-segment character 61 recognizable to those in the display art as an arrangement commonly used for variable alphanumeric representations. Light delivering tunnels 63 are indicated as being connected in the ratio of one tunnel per one segment. While the tunnels are indicated as cylindrical it will be appreciated that other shapes may be suitable. Also, light piping devices or optical fibers might be used in place of an ordinary tunnel-like void of the illustrated embodiment.

It will be appreciated that the tunnels 63 are offset from the front 62 to the back 64 of the door panel 15 so as to avoid overlapping other information segments not intended to be lit thereby. A forward tunnel 65, such as the shorter tunnel 45 of FIG. 2, is located towards the front of the door so as not to overlap with the longer, rearward tunnel 67, such as the longer tunnel 43 of FIG. 2, which may be located directly behind the forward tunnel 65. It will be appreciated that by canting the segments of the seven-segment character 61 slightly as shown while varying the placement of the tunnels connected to each segment, that a suitable arrangement for individual lighting of each segment may be accomplished without undue experimentation. Each segment can then be individually lit by a single tunnel by an LED placed proximate the tunnel opening.

Thus, according to the present invention, there has been shown a combined door and display panel which is not subject to undue shock and which contains no movable electrical connections which may be strained by movement thereof and consequently fail. It will be further appreciated that the LEDs which light the tunnels according to the present invention may be also readily placed at the bottom rather than at the top of the door and that the door need not necessarily pivot but, as in the case of some apparatus, may move on sliding armatures to a fixed position proximate the front panel of the electronic product casing to thereby be placed in proximity to the necessary LEDs.

While the present invention has been illustrated and described in connection with the preferred embodiments, it is not to be limited to the particular structure shown, because many variations thereof will be evident to one skilled in the art and are intended to be encompassed in the present invention as set forth in the following claims.

What is claimed is:

1. A combined door and display panel for media ingress/egress opening in a consumer electronics product housing comprising:

A) a door having a display surface ordinarily visible to an operator, the door having:
- i) tunnels for the transmission of light,
- ii) the tunnels extending through the door,
- iii) each tunnel having a first light-receiving end on a surface of the door other than the display surface,
- iv) a second light-emitting end exiting proximate the display surface; and
- v) means for providing for pivotal attachment of the door to the product housing; and B) an information display visible at the display surface, the information display having:
- i) light-activated, information-conveying segments,
- ii) each information-conveying segment being aligned with the second end of at least one of the tunnels.

2. The combined door and display panel of claim 1 further comprising a lens covering the second end of at least one of the tunnels to form at least one of the information-conveying segments.

3. The combined door and display panel of claim 2 wherein the lens has a reflective backing.

4. The combined door and display panel of claim 1 wherein the tunnel has a reflective portion for directing light to the display panel.

5. The combined door and display panel according to claim 1 wherein said information segment further comprises an overlay over the second end of the tunnel.

6. The combined door and display panel of claim 1 wherein at least some of said tunnels are offset from each other by having some tunnels proximate the display surface and some tunnels offset distally from the display surface.

7. The combined door and display panel of claim 1 wherein the door is a one-piece molded plate with the tunnels formed therein.

8. A consumer electronics product housing comprising:

A) a door having a display surface ordinarily visible to an operator and sized to cover a media ingress/egress opening in the consumer electronics product, the door having:
- i) tunnels for the transmission of light,
- ii) the tunnels extending through the door,
- iii) each tunnel having a first light-receiving end on a surface of the door other than the display surface, and
- iv) a second light-emitting end exiting proximate the display surface;

B) an information display visible at the display surface, the information display having:
- i) light-activated, information-conveying segments,
- ii) each information-conveying segment being aligned with the second end of at least one of the tunnels;

C) means for allowing the door to open so as to allow ingress and egress of media through the door opening;

D) light emitters positioned proximate the first ends of the tunnels; and

E) a controller for the light emitters to control transmission of light through the tunnels and light the information-conveying segments to convey information to the viewer.

9. The consumer electronics product housing according to claim 8 wherein the door is a one-piece molded plate with the tunnels formed therein.

10. The consumer electronics product housing according to claim 8 wherein the light emitters are light emitting diodes.

11. The consumer electronics product housing according to claim 8 wherein the light emitters are surrounded by hoods which extend to adjacency with the light-receiving opening of the tunnels.

* * * * *